US007138015B2

(12) United States Patent
Rytter et al.

(10) Patent No.: US 7,138,015 B2
(45) Date of Patent: Nov. 21, 2006

(54) APPARATUS FOR THE SPREADING OF ADHESIVE MATERIAL

(75) Inventors: Peter Rytter, Aalborg (DK); Nicolai Gaardsøe, Tureby (DK)

(73) Assignee: Udviklingsselskabet AF 2002 ApS, Tureby (DK)

( * ) Notice: Subject to any disclaimer, the term of this patent is extended or adjusted under 35 U.S.C. 154(b) by 70 days.

(21) Appl. No.: 10/480,589

(22) PCT Filed: Jun. 13, 2002

(86) PCT No.: PCT/DK02/00397

§ 371 (c)(1),
(2), (4) Date: Dec. 12, 2003

(87) PCT Pub. No.: WO02/100555

PCT Pub. Date: Dec. 19, 2002

(65) Prior Publication Data

US 2004/0173145 A1 Sep. 9, 2004

(30) Foreign Application Priority Data

Jun. 13, 2001 (DK) ..... 2001 00155

(51) Int. Cl.
*B05C 5/00* (2006.01)

(52) U.S. Cl. ..... 118/305; 118/207

(58) Field of Classification Search ..... 404/94, 404/118; 156/578, 574, 575, 579; 118/207, 118/305; 425/87, 458
See application file for complete search history.

(56) References Cited

U.S. PATENT DOCUMENTS 2,824,330 A * 2/1958 Williams ..... 15/245.1
3,611,470 A 10/1971 Gaston
3,803,662 A 4/1974 Glejf
3,804,696 A 4/1974 Lobmeier
4,329,081 A * 5/1982 Buvik ..... 404/110
4,700,786 A * 10/1987 Berry ..... 172/799.5
4,781,556 A * 11/1988 Paul ..... 425/62
4,789,265 A * 12/1988 Wilson et al. ..... 404/75
4,869,618 A * 9/1989 Morrison ..... 404/118
4,892,437 A * 1/1990 Kraft ..... 404/97
4,982,470 A 1/1991 Szabo
5,379,479 A 1/1995 Nelson
5,807,022 A * 9/1998 McCleary ..... 404/97

FOREIGN PATENT DOCUMENTS

| | | | |
|---|---|---|---|
| DE | 23 34 943 | | 2/1975 |
| EP | 0 471 863 | | 2/1992 |
| EP | 0 566 467 | | 10/1993 |
| EP | 1 018 585 | | 7/2000 |
| GB | 273722 | * | 2/1928 |

* cited by examiner

*Primary Examiner*—Brenda A. Lamb
(74) *Attorney, Agent, or Firm*—Stites & Harbison PLLC; Douglas E. Jackson

(57) ABSTRACT

An apparatus for the application of adhesive material, for use in the laying of flooring and roofing surfaces, comprising a frame, to which are attached a plurality of wheels, an angularly extending handle arrangement and a trowel blade whose height above a sub-floor, on which the adhesive material is to be spread, may be adjusted by some means. The apparatus is designed to be used while in a standing position and drawn across the sub-floor.

29 Claims, 2 Drawing Sheets

APPARATUS FOR THE SPREADING OF ADHESIVE MATERIAL

TECHNICAL FIELD

The present invention relates generally to the spreading of adhesive materials, and more specifically to a tool for spreading a layer of adhesive over a surface, such as a floor.

BACKGROUND ART

Numerous types of flooring are laid upon underlying sub floors or concrete slabs and fixed using adhesive materials. The adhesive must be spread evenly over the underlying surface prior to the placement of the covering material. For example carpets, tiles, laminate boards and roll out flooring materials are all applied over an adhesive. It should also be noted that the present invention should not be limited to flooring but can be utilised in the laying of roofing materials as well.

Typically, the adhesives are spread by hand trowel such as the one described in EP 1,018,585A1, where the persons spreading the adhesive would carry out the work on their knees. This results in the work being physically difficult and relatively slow, especially where large areas like industrial complexes are concerned.

Attempts have been made in the past to improve on this known technique but with limited success. The improvements have typically involved the trowel being able to be used whilst the person is in an upright position. Examples of these can be seen in U.S. Pat. Nos. 4,982,470, 3,803,662 and 3,611,470 where the tool can either be dragged or drawn to spread the adhesive layer.

As mentioned above, these adhesive spreaders have various limitations and are not as effective as they might be. It has been noted that there is still a need to be able to reliably spread an even layer of adhesive material using non-complex machinery, which can be easily cleaned after use. Machinery known in the field uses compressors and external electrical sources to apply the adhesive and power the machinery. This has the disadvantage of lacking versatility, due to their size and weight, and as large compressors are needed to be set up before the spreader can function and many building sites where the spreader may be used do not have guaranteed electrical sources.

It would be desirable to provide a spreader which could lay a membrane or layer of adhesive material of a predetermined thickness with tolerable accuracy and which is easy to use from a standing position. It would also be desirable if the spreader had some capability to reliably and evenly distribute the adhesive material ahead of the oncoming spatula blade. A further desirable attribute would be the ability to remove excess adhesive material when required. And to do all this with a tool which is easy to maintain and clean and which requires no external input other than the driving force given by the person operating it would also be most desirable.

DISCLOSURE OF THE INVENTION

The present invention consists of a length of trowel blade that may run the width of the tool and be held securely in place by a rigid frame. Said trowel blade edge may be serrated, toothed or exhibit any pattern so desired and the upper edge may possibly exhibit a different pattern, thus giving each blade two different pattern possibilities requiring that said trowel blade be only rotated to expose the required edge. The present invention may primarily be drawn by a handle arrangement that extends angularly from the rear and may be hingably connected with said frame to enable the present invention to be easily transported and stored. The present invention may also run on one or more axially aligned wheels which may be situated at the rear of the frame and whose position may be altered in the horizontal and vertical directions, respectively. The frame itself comprises one or more compartments itself comprising a suitably shaped opening in its base. The lid of said compartment may be comprised of a rigid, flat surface sealed by some means while still allowing said lid to slide vertically up and down within said compartment. A mechanism for raising and lowering said lid by predetermined amounts to exert a corresponding pressure might also be included. This system may enable said compartment(s) to accommodate a bag or amount of adhesive material which, when punctured and said lid is lowered by a predetermined amount, delivers a sausage of adhesive material through which the trowel blade will be drawn.

According to one embodiment of the present invention, the main body is basically a rectangular box which houses the compartment or compartments containing adhesive material and a frame on which the trowel blade is secured.

The two juxtaposed side panels may be triangularly shaped at their base thus providing a point about which said main body can pivot. The aforementioned wheel axle as previously described can be moved in the vertical axis and by so doing increases or decreases the distance between the said trowel blade and subfloor as the main housing pivots about the point of the triangularly shaped base of the side panels much like a seesaw. Thus by securing the height of the wheel axle in predetermined positions, a corresponding height of the trowel blade above the subfloor may be translated via the triangular fulcrum of the side panels. A method as according to the first embodiment for securing the height of the wheel axle is to have the axle attached to one end of a rod, which is pivotally joined to the frame between the two ends, and where the remaining end can be moved up and down and secured to any of the plurality of pre-positioned holes located in the frame by way of a bolt which passes through both the hole in the end of the rod and one of the said pre-positioned frame holes. Thus, the height of the axle can be secured at predetermined positions by moving the lever end of the rod either up or down which moves pivotally about a point.

A predominantly flat panel lying horizontally and rigidly attached to a handle mechanism may be incorporated into the main housing in such a way that when fully retracted it does not hinder the delivery or spreading of the adhesive material but when pushed in scoops and collects all excess adhesive material from the subfloor. The novel features believed characteristic of the invention are set forth in the appended claims.

According to a second embodiment of the invention, the apparatus comprises a frame on which is secured a trowel blade which may be provided with side panels for the retention of the adhesive material within a desired region and may provide a housing, in the form of elongated holes, for one or more screws which may be adjusted to alter the height of the trowel blade above the sub-floor. The apparatus may also consist of a weight attached to the frame which provides the required downward pressure to the trowel blade.

This embodiment may also comprise a handle arrangement, attached to the frame and extending angularly there-from, to enable the user to draw the apparatus along the sub-floor, through an amount of adhesive material, while in an upright position.

BRIEF DESCRIPTION OF THE DRAWINGS

The invention itself, as well as a preferred mode of use, and further objects and advantages thereof, will be best understood by reference to the following detailed description of an illustrative embodiment when read in conjunction with accompanying drawings, wherein.

DETAILED DESCRIPTION OF THE PREFERRED EMBODIMENT

Figure 1:
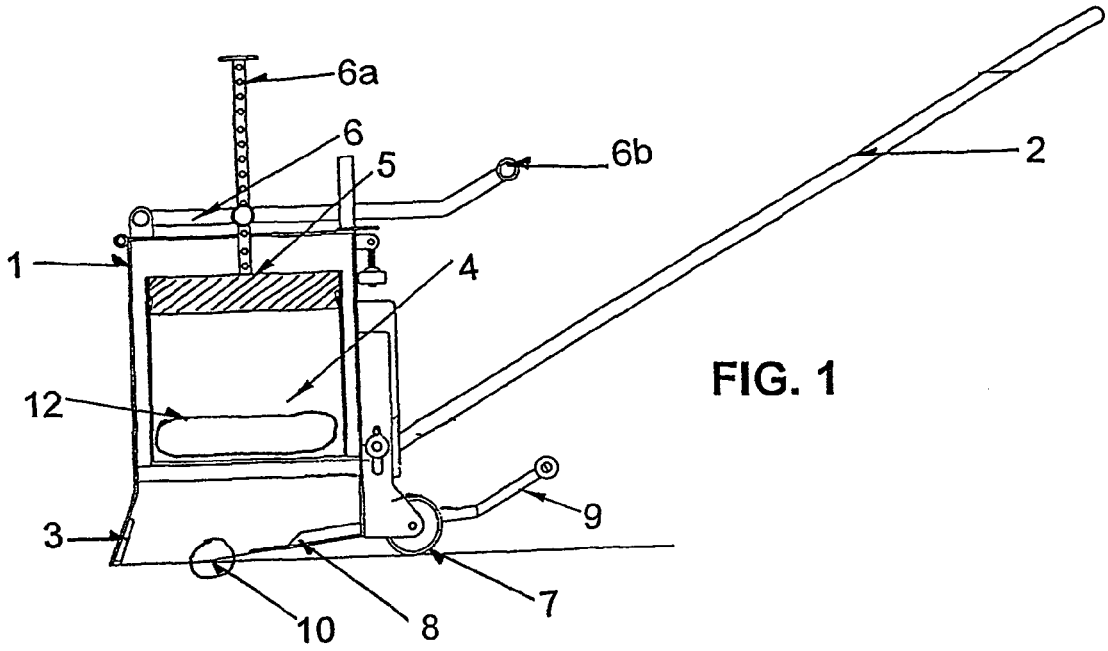
FIG. 1 is a side view of the first preferred embodiment of a spreader according to the present invention.

FIG. 1 is a side view of a presently preferred spreader 1 according to the present invention. The spreader 1 includes a handle arrangement 2, which extends from the spreader 1 angularly and is hingably joined at its base. The spreader 1 also includes a double edged trowel blade 3 which is secured to the spreader's front end by a plurality of bolts which can be loosened to enable the trowel blade 3 to be rotated and so expose its other edge which exhibits a different toothed pattern.

FIG. 1 also shows that the preferred spreader includes a pair of compartments 4 where each compartment is in the form of a rectangular box and includes a hermetically sealed lid 5 which can be raised or lowered into the compartment 4 by way of the mechanism 6. In this embodiment, the lowering mechanism is comprised of a column 6*a* with a plurality of equidistant holes passing through said column 6*a* and a lever 6*b* hingably joined to the front end of the preferred spreader 1. Said lever 6*b* is positioned at the required height corresponding to the desired distance the lid 5 is required to be lowered and a bolt is passed through a hole in the lever 6*b* and the corresponding hole in the column 6*a*. A downward vertical force is then applied to said lever 6*b* which lowers the lid 5 into the compartment 4 and compresses the bag containing adhesive material 12 which has been punctured along the base in the area of the slit 11 shown in FIG. 2, allowing the adhesive material to fall as a sausage onto the subfloor beneath.

Also shown in FIG. 1 is the horizontal panel 8 which extends the width of the spreader 1 and can be retracted to its dormant position as shown in FIG. 1 by pulling the handle mechanism 9 fully back. When the handle mechanism 9 is pushed forward, the horizontal panel 8 advances and descends towards the trowel blade 3 reaching the level of the subfloor just before the rear limit of the slit 11 shown in FIG. 2. As the horizontal panel 8 is advanced, it scrapes along the subfloor advancing any adhesive material towards the trowel blade 3 which resists the oncoming adhesive material and forces the adhesive material onto the still advancing horizontal panel 8. This enables any excess adhesive material to be removed from the subfloor to enable the preferred spreader to be moved.

Figure 2:
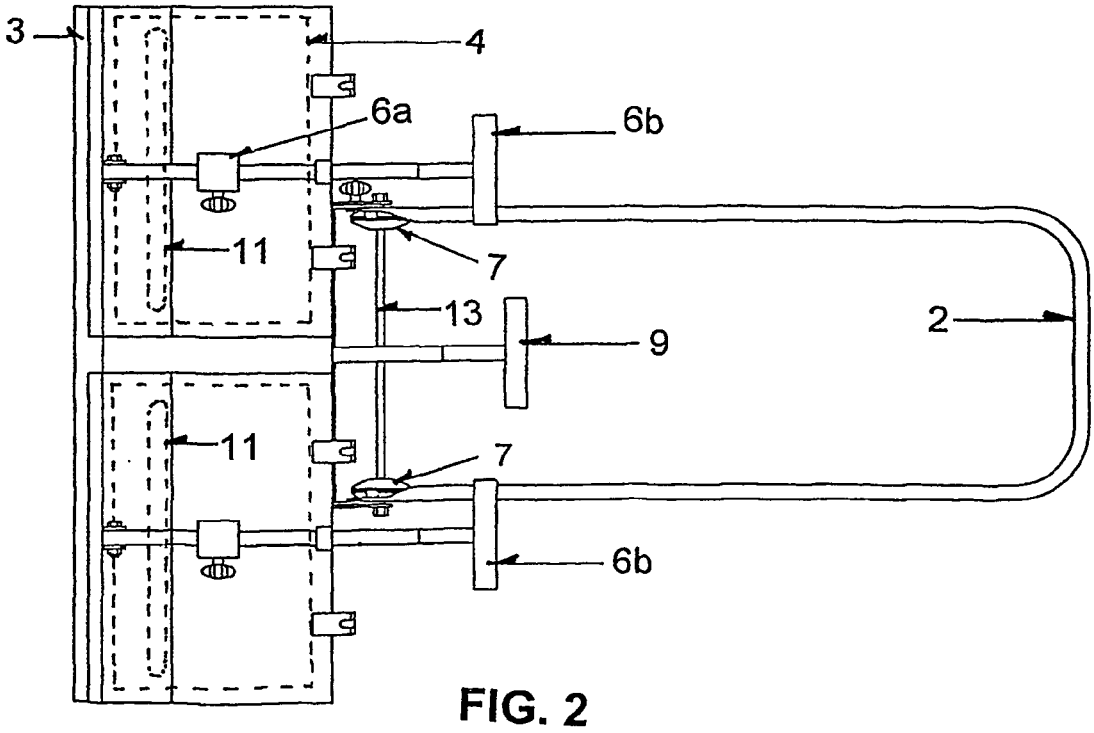
FIG. 2 is a plan view of the first preferred embodiment of a spreader according to the present invention.

FIG. 2 shows that the preferred spreader 1 also includes an axle situated at the rear and holding a pair of wheels 7 which can move independently of each other along the axle 13 to give the required degree of stability. It can be noted that when the wheels 7 are positioned towards the centre of the preferred spreader 1 any irregularities in the subfloor surface are reduced resulting in a more even thickness of adhesive material spread. Said wheel axle 13 can also move vertically as shown in FIG. 1 resulting in the wheels being raised or lowered. This in turn results in the trowel blade 3 being lowered and raised, respectively, with the only point not experiencing a vertical movement being the pivot point 10. The mechanism to enable the wheels 7 to be raised or lowered to predetermined positions comprises a lever which is pivotally attached to the frame at some point between its two ends. One end is rigidly attached to the wheel axle 13 while the other contains a hole. A plurality of holes are found in the side of the spreader 1 laid out in a manner which will line up with the lever hole to give a plurality of different fixture position possibilities. These holes can be situated such that they correspond to a predetermined wheel axle 13 height which is deemed useful. Once the wheel axle 13 is at the desired height, a bolt may be inserted through the corresponding holes, thus securing the position.

Figure 3:
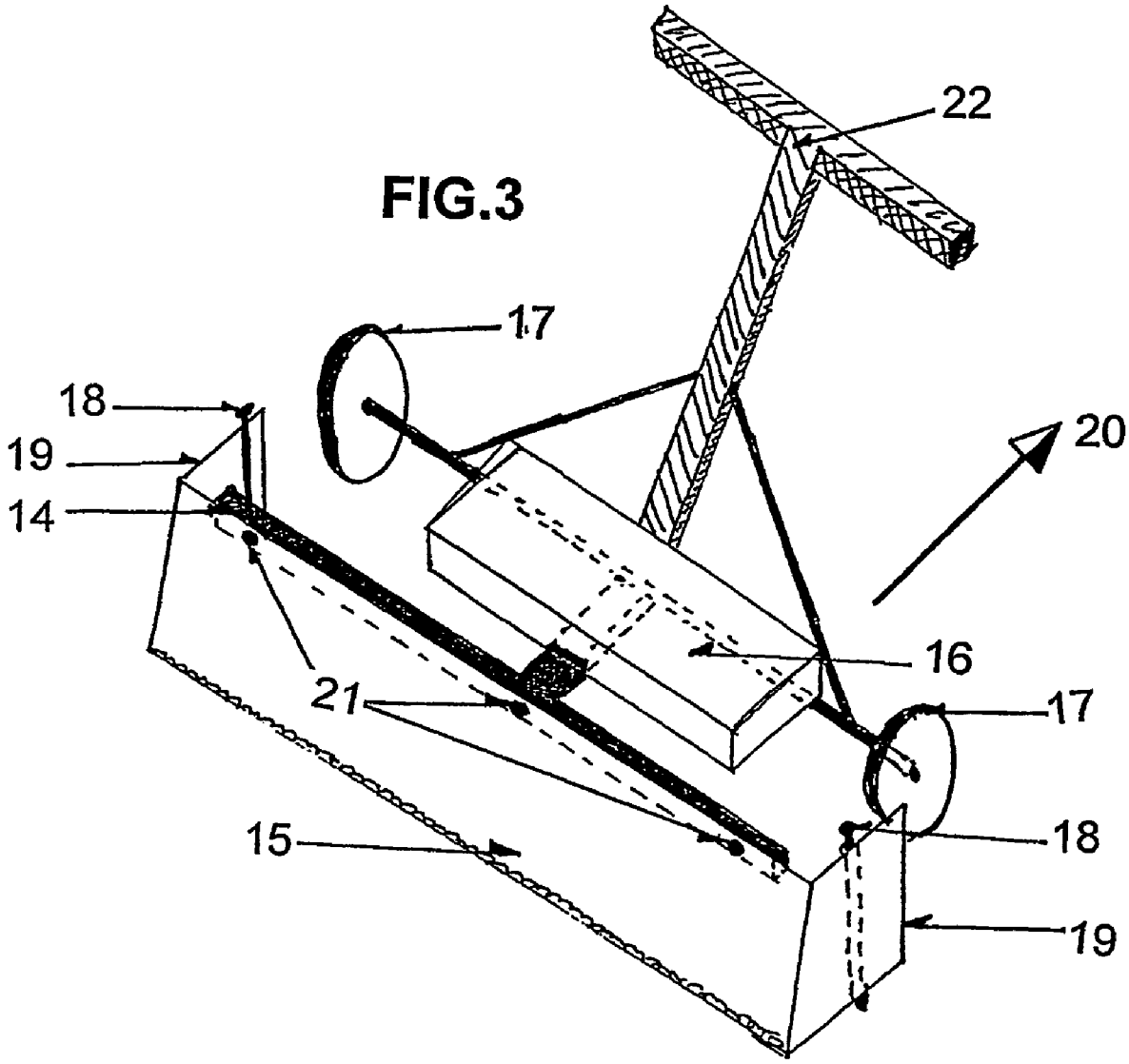
FIG. 3 is an isometric view of the second embodiment of a spreader according to the present invention.

As shown in FIG. 3 and according to the second embodiment of the invention, the apparatus comprises a frame 14 which secures a trowel blade 15 in its correct position in relation to the sub-floor over which the trowel blade 15 is moving, and upon which the trowel blade 15 is being pressed down with the aid of a weight 16 situated on the frame 14 between the trowel blade 15 and a set of wheels 17.

In order to adjust the height of the trowel blade 15 above the sub-floor there are provided two adjustment screws 18 whose bottom ends glide along the sub-floor. Furthermore, the second embodiment is provided with side panels 19 which confine the adhesive material within the length of the trowel blade 15 as the apparatus moves across the sub-floor in direction 20.

The height of one of the wheels 17 can be advantageously adjusted in relation to the height of the other wheel and used in connection with the spreading of a significant thickness of adhesive material whereby one wheel 17 may run along the sub-floor while the other may roll along the recently laid flooring surface, i.e. the wheels 17 are rolling at different heights. The trowel blade 15 is preferably changeable as indicated by the presence of three screws 21 to secure the trowel blade 15 to the frame 14. Furthermore, it can be seen that these screws 21 are placed in elongated holes, whereby the trowel blade's position with regard to the frame 14 can be adjusted. FIG. 3 also shows a handle arrangement 22 which extends angularly from the frame 14 to which it is rigidly attached.

Although the present invention has been described in terms of the above two embodiments, it is understood that the scope of the invention is not limited to these embodiments but that a person skilled in the art may conceive other embodiments without departing from the scope of the invention as defined by the accompanying claims.

The invention claimed is:

1. An apparatus for the application of adhesive materials, e.g. flooring or tile adhesive or similar for the laying of flooring or roofing surfaces, said apparatus comprising:

a frame for the securing of a trowel blade which said trowel blade determines a thickness and/or structure of adjacent said adhesive materials on a subfloor when said trowel blade is in a correct position with regard to the subfloor over which said frame is being moved, wherein said frame includes at least one pivot point about which said frame may pivot relative to the subfloor; and wherein said frame is provided with means for adjusting a position of said frame about said at least one pivot point, whereby the correct position of said trowel blade relative to the subfloor is obtained; and wherein said pivot point is comprised of two juxtaposed side panels having a triangularly or rounded shaped base.

2. An apparatus according to claim 1, wherein said trowel blade is patterned on both upper and lower edges thereof.

3. An apparatus according to claim 2, wherein said trowel blade is changeable.

4. An apparatus according to claim 1, further comprising a movable, flat and horizontal panel rigidly attached to a handle mechanism.

5. An apparatus according to claim 4, wherein said horizontal panel can be maneuvered to scrape the subfloor clean of adhesive material.

6. An apparatus according to claim 1, further comprising a handle arrangement hingedly attached to said frame.

7. An apparatus according to claim 6, wherein said handle arrangement extends angularly to a height comfortable for the user to draw said frame.

8. An apparatus according to claim 1, further comprising adjustment means for the trowel blade's position relative to said frame and hence the height of said trowel blade above the subfloor.

9. An apparatus for the application of adhesive materials, e.g. flooring or tile adhesive or similar for the laying of flooring or roofing surfaces, said apparatus comprising:

a frame for the securing of a trowel blade which said trowel blade determines a thickness and/or structure of adjacent said adhesive materials on a subfloor when said trowel blade is in a correct position with regard to the subfloor over which said frame is being moved, wherein said frame is provided with means for adjusting a position of said frame relative to said subfloor, whereby the correct position of said trowel blade relative to the subfloor is obtained, and further comprising a weight which applies a required downward pressure upon the trowel blade.

10. An apparatus for the application of adhesive materials, e.g. flooring or tile adhesive or similar for the laying of flooring or roofing surfaces, said apparatus comprising:

a frame for the securing of a trowel blade which said trowel blade determines a thickness and/or structure of adjacent said adhesive materials on a subfloor when said trowel blade is in a correct position with regard to the subfloor over which said frame is being moved, wherein said frame is provided with means for adjusting a position of said frame relative to said subfloor, whereby the correct position of said trowel blade relative to the subfloor is obtained, and wherein the trowel blade is provided with side panels for the confinement of the adhesive material within a desired region.

11. An apparatus for the application of adhesive materials, e.g. flooring or tile adhesive or similar for the laying of flooring or roofing surfaces, said apparatus comprising:

a frame for the securing of a trowel blade which said trowel blade determines a thickness and/or structure of adjacent said adhesive materials on a subfloor when said trowel blade is in a correct position with regard to the subfloor over which said frame is being moved, one or more containers with a suitable opening therein, said suitable opening being an array of holes running a width of each said container, and wherein said frame is provided with means for adjusting a position of said frame relative to said subfloor, whereby the correct position of said trowel blade relative to the subfloor is obtained.

12. An apparatus according to claim 11, wherein said trowel blade is patterned on both upper and lower edges thereof.

13. An apparatus according to claim 12, wherein said trowel blade is changeable.

14. An apparatus according to claim 11, further comprising a movable, flat and horizontal panel rigidly attached to a handle mechanism.

15. An apparatus according to claim 14, wherein said horizontal panel can be maneuvered to scrape the subfloor clean of adhesive material.

16. An apparatus according to claim 11, further comprising a handle arrangement hingedly attached to said frame.

17. An apparatus according to claim 16, wherein said handle arrangement extends angularly to a height comfortable for the user to draw said frame.

18. An apparatus according to claim 11, further comprising adjustment means for the trowel blade's position relative to said frame and hence the height of said trowel blade above the subfloor.

19. An apparatus according to claim 11, wherein said container includes a lid.

20. An apparatus according to claim 19, wherein said lid can move freely vertically within said container.

21. An apparatus for the application of adhesive materials, e.g. flooring or tile adhesive or similar for the laying of flooring or roofing surfaces, said apparatus comprising:

a frame for the securing of a trowel blade which said trowel blade determines a thickness and/or structure of adjacent said adhesive materials on a subfloor when said trowel blade is in a correct position with regard to the subfloor over which said frame is being moved, at least one wheel which can move horizontally along its axle, and wherein said frame is provided with means for adjusting a position of said frame relative to said subfloor, whereby the correct position of said trowel blade relative to the subfloor is obtained.

22. An apparatus according to claim 21, wherein said wheel or wheels can move vertically.

23. An apparatus according to claim 21, wherein said trowel blade is patterned on both upper and lower edges thereof.

24. An apparatus according to claim 23, wherein said trowel blade is changeable.

25. An apparatus according to claim 21, further comprising a movable, flat and horizontal panel rigidly attached to a handle mechanism.

26. An apparatus according to claim 25, wherein said horizontal panel can be maneuvered to scrape the subfloor clean of adhesive material.

27. An apparatus according to claim 21, further comprising a handle arrangement hingedly attached to said frame.

28. An apparatus according to claim 27, wherein said handle arrangement extends angularly to a height comfortable for the user to draw said frame.

29. An apparatus according to claim 21, further comprising adjustment means for the trowel blade's position relative to said frame and hence the height of said trowel blade above the subfloor.

* * * * *